US007987648B1

(12) United States Patent
Ryan

(10) Patent No.: US 7,987,648 B1
(45) Date of Patent: Aug. 2, 2011

(54) MODULAR WALL PANEL SYSTEM

(76) Inventor: Jeffrey Ryan, Pasadena, MD (US)

( * ) Notice: Subject to any disclaimer, the term of this patent is extended or adjusted under 35 U.S.C. 154(b) by 275 days.

(21) Appl. No.: 12/380,245

(22) Filed: Feb. 25, 2009

Related U.S. Application Data

(60) Provisional application No. 61/067,453, filed on Feb. 28, 2008.

(51) Int. Cl.
*E04B 2/00* (2006.01)

(52) U.S. Cl. ..... 52/506.06; 52/235; 52/311.2

(58) Field of Classification Search ..... 52/506.05, 52/506.06, 506.01, 508, 235, 311.2, 455
See application file for complete search history.

(56) References Cited

U.S. PATENT DOCUMENTS

| | | | | |
|---|---|---|---|---|
| 2,046,593 | A | 7/1936 | Urbain | |
| 2,048,132 | A | 7/1936 | Madsen | |
| 2,803,858 | A | 8/1957 | Rader | |
| 4,107,887 | A * | 8/1978 | Wendt | 52/105 |
| 4,353,193 | A | 10/1982 | Sanderson | |
| 4,577,444 | A | 3/1986 | Sanderson | |
| 4,592,966 | A | 6/1986 | Prior et al. | |
| 4,736,559 | A | 4/1988 | Young | |
| 4,765,111 | A * | 8/1988 | Osawa | 52/509 |
| 5,095,671 | A * | 3/1992 | Mitani | 52/210 |
| 5,414,971 | A | 5/1995 | Handte | |
| 5,598,667 | A | 2/1997 | Dykes | |
| 5,623,800 | A | 4/1997 | Shinkosky | |
| 5,884,444 | A | 3/1999 | Harris | |
| 5,894,701 | A | 4/1999 | Delorme | |
| 6,138,423 | A | 10/2000 | Poutanen et al. | |
| 6,202,377 | B1 | 3/2001 | Krieger | |
| 6,341,461 | B1 | 1/2002 | Crowley et al. | |
| 6,751,915 | B2 | 6/2004 | Crowley | |
| 6,942,108 | B2 | 9/2005 | Wons et al. | |
| 7,168,474 | B2 | 1/2007 | Lam | |
| 2002/0017066 | A1 * | 2/2002 | Marshall et al. | 52/220.2 |
| 2003/0029109 | A1 | 2/2003 | Hellberg | |
| 2004/0148893 | A1 | 8/2004 | Kornfalt | |
| 2006/0070329 | A1 | 4/2006 | Schiltz | |
| 2006/0080939 | A1 | 4/2006 | Bledsoe et al. | |
| 2007/0022682 | A1 * | 2/2007 | Morgenegg et al. | 52/235 |
| 2007/0034341 | A1 | 2/2007 | Lam | |
| 2007/0251174 | A1 * | 11/2007 | Chung | 52/455 |
| 2010/0000168 | A1 * | 1/2010 | Weiser | 52/235 |

* cited by examiner

*Primary Examiner* — Robert J Canfield
*Assistant Examiner* — Brent W Herring
(74) *Attorney, Agent, or Firm* — Whiteford, Taylor +Preston LLP; Gregory M. Stone, Esq.

(57) ABSTRACT

A decorative, modular wall panel system is disclosed that allows easy installation and that is adaptable to a variety of wall lengths by allowing the decorative panels to float on an easily installed frame assembly. A skeletal, hidden frame structure is attached to the preexisting wall over which the modular wall panel system is to be installed, and is configured to hold the decorative panel system in place without penetrating the decorative members with fasteners such as nails or screws, thus eliminating the need for wood fillers, plugs, caulking, paints, or stains and touch-up kits to fix blemishes on the decorative panels that would otherwise be caused by attaching them to a wall surface.

18 Claims, 7 Drawing Sheets

MODULAR WALL PANEL SYSTEM

CROSS REFERENCE TO RELATED APPLICATION

This application is based upon and claims priority from U.S. Provisional Patent Application Ser. No. 61/067,453, entitled "Modular Wall Panel System", filed with the U.S. Patent and Trademark Office on Feb. 28, 2008 by the inventor herein, the specification of which is incorporated herein by reference.

FIELD OF THE INVENTION

The present invention relates generally to wall coverings, and more particularly to a floating, decorative, modular wall panel system allowing easy installation and adaptable to a variety of wall lengths. The wall panel system preferably includes decorative panels incorporating interchangeable sections that may incorporate decorative inserts and/or peripheral devices, such as sections of differing panel designs and/or materials, electrical connectors, data and/or communication ports, and other similarly configured devices, so as to provide easy adaptation of desired or required decorative, electrical, communication, and lighting devices into a newly installed panel system without requiring modification of the underlying wall structure or existing electrical, communication, or lighting components.

BACKGROUND OF THE PRIOR ART

A number of systems have previously been provided for decorating walls with decorative panels, such as in wainscoting applications. In a conventional installation of such decorative panels, a skilled carpenter is typically required to expend significant time and effort in laying out the panel configuration for the specific wall surface to be covered and in installing the panels. Moreover, such efforts typically require the use of a number of different power tools and air-driven fasteners to attach the panels to the wall surface. After the installer has finished, a skilled painter is then typically required to fill, sand, and prepare all of the decorative surfaces before applying paints, stains, or varnishes of at least two coats, sanding between each coat, and cleanup after the painting or staining process is completed.

This process can take several days to complete, and with the additional time required to schedule the various contractors needed to complete the job, a homeowner may face a significant length of time in order to accomplish a relatively minor and cosmetic home improvement. Moreover, the sanding, painting, and drying time associated with such task creates mess and unpleasant odors that the homeowner must deal with during the installation process.

It would therefore be advantageous to provide a decorative wall system that could be easily installed without the need for specialist contractors or with specialized tools, and that minimized the mess and other inconveniences associated with traditional wall system installation projects. It would also be advantageous to provide such a decorative wall system that includes a mounting system that does not require penetrating fasteners, such as nails, screws, or the like, that typically remain visible after installation (thus requiring careful finishing of the exterior surface after installation).

Moreover, use of such prior known decorative panel systems typically results in a new, permanently modified appearance for the wall. Should the homeowner thereafter wish to further modify the appearance of the wall, it will typically require a minimum of removing the installed panels, and possibly refinishing or even rebuilding portions of the underlying wall surface. It would therefore also be advantageous to provide a decorative wall system that would allow easy modification of the panel system to incorporate various alternate appearances in order to vary the aesthetic appeal as the homeowner might desire.

Still further, if the panel system is to be installed on a wall having electrical outlets, cable television outlets, data ports, speaker jacks, or other electrical, data, and/or communications ports, incorporation of prior known decorative panel systems has typically required careful planning and placement of components, and at times rerouting of such electrical, data, and/or communications ports, in order to properly align such connection hardware with appropriate portions of the panel system. It would therefore also be advantageous to provide a decorative wall panel system that could allow placement of components of the decorative wall panel system and incorporate required peripheral electronic devices, such as electrical, data, and/or communications ports, without requiring modification, rerouting, or rewiring of existing electrical, data, and/or communications ports in the wall on which the panel system is to be installed.

SUMMARY OF THE INVENTION

Disclosed is a decorative, modular wall panel system allowing easy installation that is adaptable to a variety of wall lengths by allowing the decorative panels to float on an easily installed, hidden frame assembly. The decorative, modular wall panel system allows a homeowner to quickly and easily change the appearance and improve the aesthetic appeal of a wall without requiring specialized skills or expert installers or other home improvement contractors, and is configured to allow easy integration of peripheral components (such as electrical outlets, data ports, communication ports, and the like) without requiring modification of the underling wall structure or existing components.

Horizontal frame members are attached to a wall surface (or optionally directly to structural wall members, such as wall studs) using simple fasteners, such as screws, to provide a skeletal, hidden support structure for the decorative wall panel system. The skeletal, hidden support structure is configured to hold the decorative panel system in place without penetrating the decorative members with fasteners such as nails or screws, thus eliminating the need for wood fillers, plugs, caulking, paints, or stains and touch-up kits to fix blemishes on the decorative panels that would otherwise be caused by attaching them to a wall surface. Moreover, by eliminating the need for such penetrating fasteners, the decorative panels may be provided in a completely pre-finished form, whether stained, painted, or otherwise, further minimizing the effort required by the installer to install the system.

Horizontal decorative strips are grooved along their long edges to receive in a loose tongue and groove configuration portions of the horizontal frame members. Vertical decorative strips are provided tongues along their short edges (located at the tops and bottoms of the vertical strips), which tongues are configured for insertion into the grooves on the horizontal decorative strips (along with the adjacent portion of the associated horizontal frame member). Vertical decorative panels are likewise provided with upper and lower clips on their back surface, which clips are configured to likewise engage the grooves in the horizontal decorative strips to hold the vertical decorative panels in place. As neither the vertical decorative strips nor the vertical decorative panels are affixed to the frame members or the wall, they are relatively free-floating between the upper and lower horizontal decorative strips. Thus, each of the vertical decorative strips and the vertical decorative panels may be slid horizontally, adjusting the spacing between vertical decorative panels as needed to fit whatever the width dimension of the wall on which the system is to be installed. This floating configuration allows the wood components of the system to breath or expand and contract in response to changes in temperature or humidity. Likewise, such floating configuration greatly reduces the possibility of warping of wood members. Still further, such simplistic configuration creates a fast, simple method for installing a decorative wall panel system, and allows easy removal of the system if it is desired to move the decorative system to another wall.

The modular, decorative wall panel system described herein requires minimal effort to attach the decorative members to the frame, thus greatly easing installation over previously known wall panel systems. More particularly, the fact that only the skeletal underlying frame members need be permanently affixed to the underlying wall structure, and that such permanent connection can be easily made with a small number of fasteners, greatly eases installation even for the inexperienced do-it-yourself homeowner. Likewise, such configuration makes it very easy to remove and reuse the wall panel system somewhere else, for instance if the homeowner wishes to undertake future remodeling after the panel system has been installed.

The decorative panels provided with the modular wall system may optionally be hinged using concealed hinges, thus allowing easy access to the open space behind the decorative panels. As a result, the modular, decorative wall panel system described herein may be used to conceal wall safes, electronic equipment, televisions or monitors, or any other devices that a user might wish to incorporate. Moreover, the decorative panels may optionally be fitted with interchangeable insert panels, thus allowing the homeowner to change either the appearance or function of portions of the wall panel system, such as by inserting decorative (e.g., frosted glass) insert panels, or alternately insert panels incorporating peripheral electronic devices (e.g., electrical outlets, communication ports, data ports, speakers, lighting, etc.). Such decorative panels are thus configured such that after they are installed, sufficient space is provided behind the decorative panels to receive and conceal cabling for any electronic, communication, or data outlets, avoiding the need to open and thereafter repair drywall to reroute such cabling.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF THE INVENTION

The invention summarized above may be better understood by referring to the following description, which should be read in conjunction with the accompanying drawings in which like reference symbols are used for like parts. This description of an embodiment, set out below to enable one to build and use an implementation of the invention, is not intended to limit the enumerated claims, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
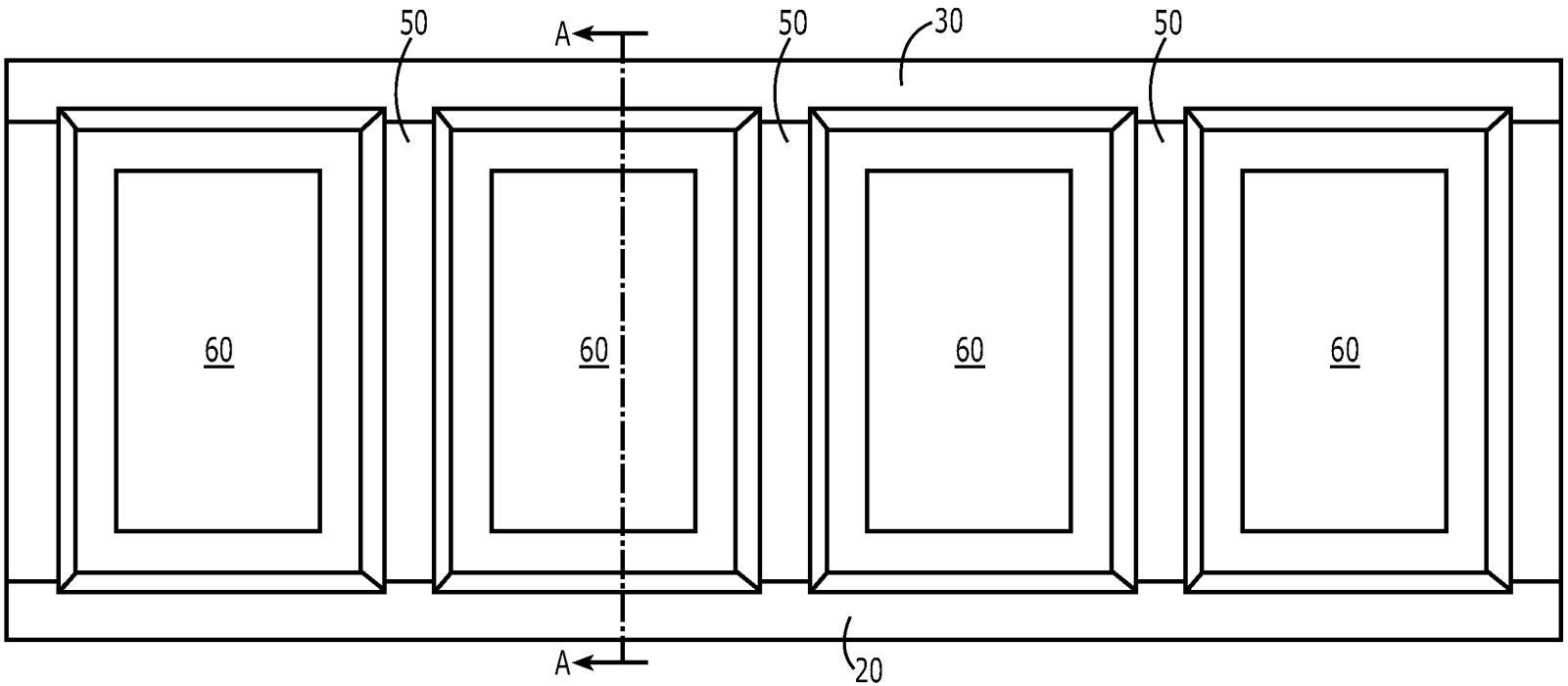
FIG. 1 is a partial view of a wall with a particularly preferred embodiment of the invention installed thereon.

Referring to the drawings, FIG. 1 is a partial view of a wall 100 on which a decorative, modular wall panel system according to a particularly preferred embodiment of the invention has been installed. A number of decorative panels 60 are positioned within and bordered by a plurality of vertical decorative strips 50, a bottom decorative strip 20, and a top decorative strip 30, all of which are mounted to a wall using a hidden, skeletal frame (discussed in greater detail below) so as to avoid the use of penetrating fasteners, such as nails, screws, or the like. By eliminating the need for such penetrating fasteners, the outer decorative surfaces of decorative panels 60, vertical decorative strips 50, bottom decorative strips 20, and top decorative strips 30 remain unblemished, and in fact may comprise pre-finished surfaces, as the traditional need for filling of nail holes and retouching of paints or stains is eliminated.

Figure 2:
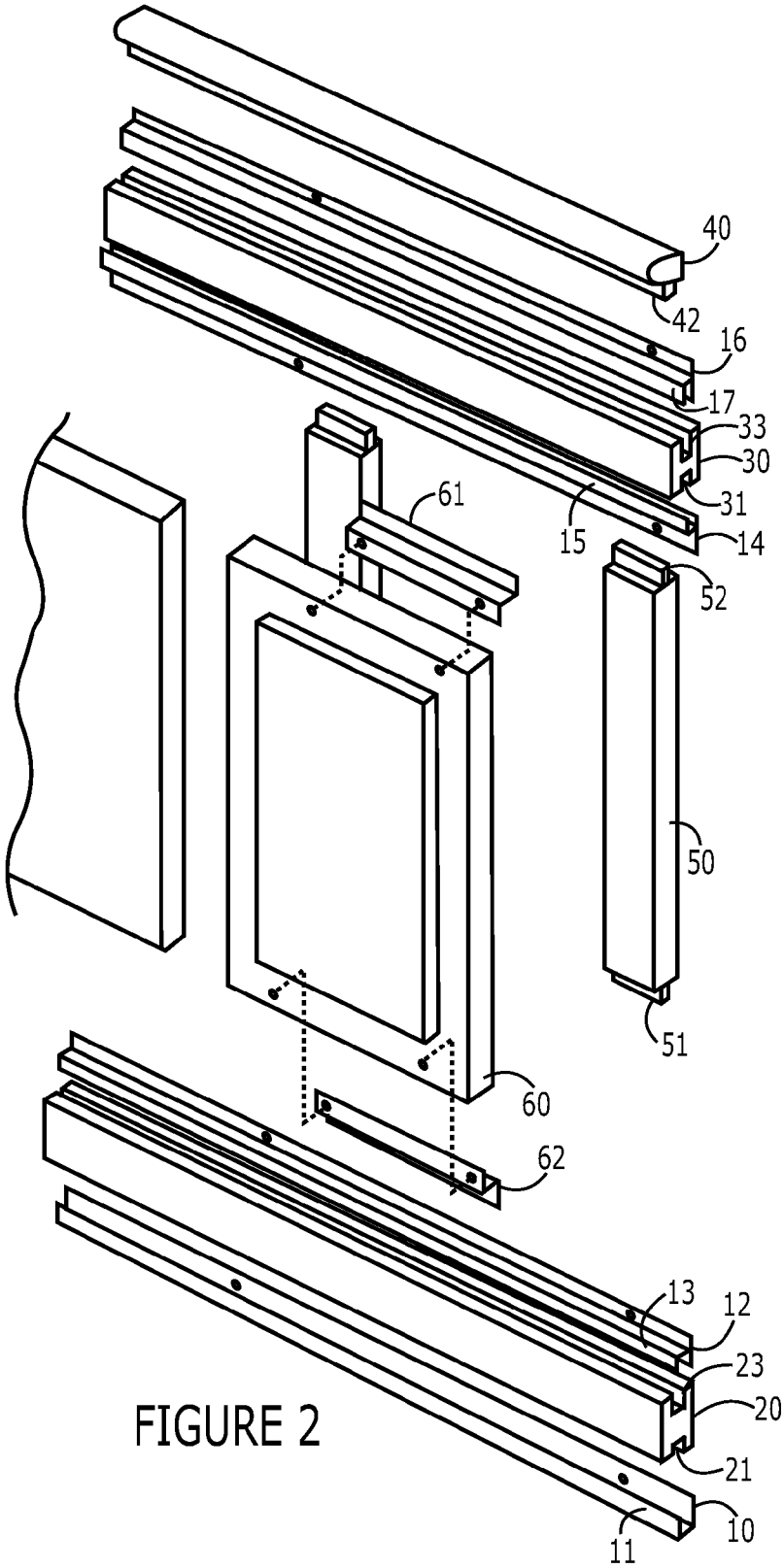
FIG. 2 is an exploded perspective view of the modular wall panel system of FIG. 1.
Figure 3:
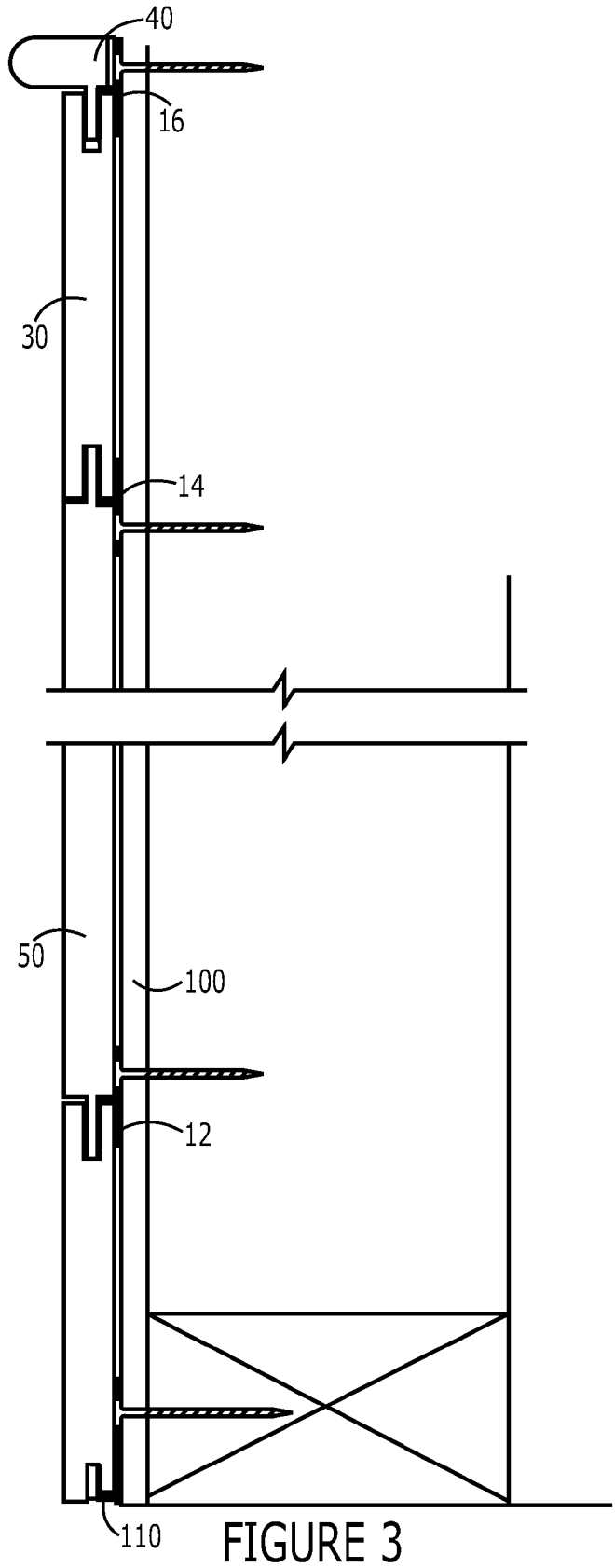
FIG. 3 shows a side, cross-sectional view of certain components of the modular wall panel system of FIG. 1.
Figure 4:
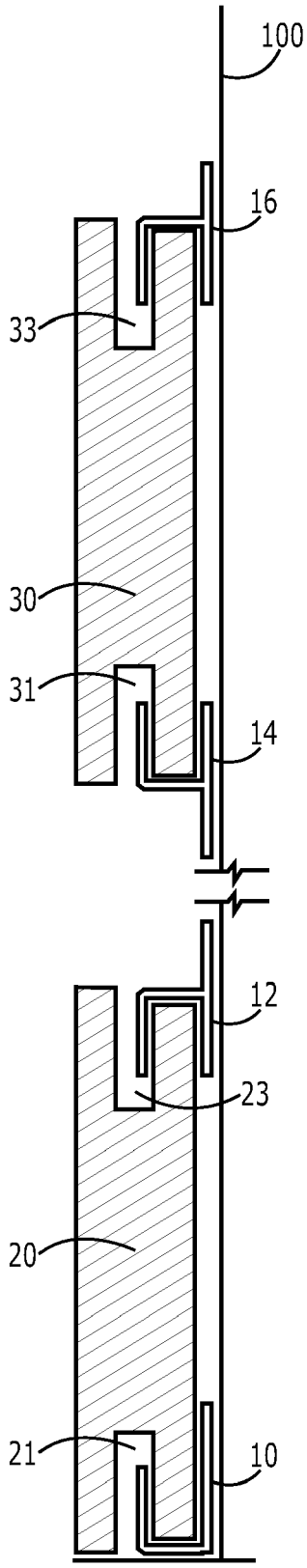
FIG. 4 shows a side, cross-sectional view of top and bottom decorative strips for use with the modular wall panel system of FIG. 1.

As best seen in the exploded perspective view of FIG. 2 and the side, sectional view of FIG. 3, bottom rail 10 (preferably in the form of a J channel), lower intermediate rail 12, upper intermediate rail 14, and top rail 16 (each preferably in the form of an H channel) of the horizontal frame are all configured for fixed attachment to a wall 100. The horizontal frame members are preferably formed of extruded aluminum, but may likewise be comprised of injected molded plastic, other metals such as steel, wood, or any other rigid or semi-rigid materials generally having the geometric configuration described herein to allow the decorative elements to float with respect to the wall surface on which they are mounted. Bottom horizontal decorative strip 20 (shown in detail in FIG. 4) is provided a bottom groove 21 configured to receive a front lip 11 of bottom rail 10, which in turn may be attached to wall 100 using a screw or similarly configured connector. Optionally, a notch may be provided on the back of each of the decorative strips in a portion of their back walls adjacent the horizontal frame members to provide a more precise fit of the decorative panels against wall 100. The top of bottom horizontal decorative strip 20 is likewise provided a groove 23 configured to receive a downwardly extending lip of lower intermediate rail 12. Groove 23 may be formed, for example, using a ¼" wide router straight bit set to ¾" depth, cutting a continuous groove along the entire top edge of bottom horizontal decorative strip 20. When lower intermediate rail 12 is anchored to the wall, bottom horizontal decorative strip 20 is likewise locked vertically in place by bottom rail 10 and lower intermediate rail 12.

Similarly, top horizontal decorative strip 30 (shown in detail in FIG. 2) is provided a bottom groove 31 configured to receive an upwardly extending front lip 15 of upper intermediate rail 14. The top of top horizontal decorative strip 30 is likewise provided a groove 33 configured to receive a downwardly extending front lip 17 of top rail 16. Top decorative strip 30 is thus likewise vertically locked in place by upper intermediate rail 14 and top rail 16.

Preferably, a top horizontal trim cap 40 is provided at the top of the modular wall system, and is provided a downwardly extending tongue 42 configured for insertion into groove 33 on top horizontal decorative strip 30. Top horizontal trim cap 40 thus provides a finished appearance to the top of the modular wall system.

Figure 5:
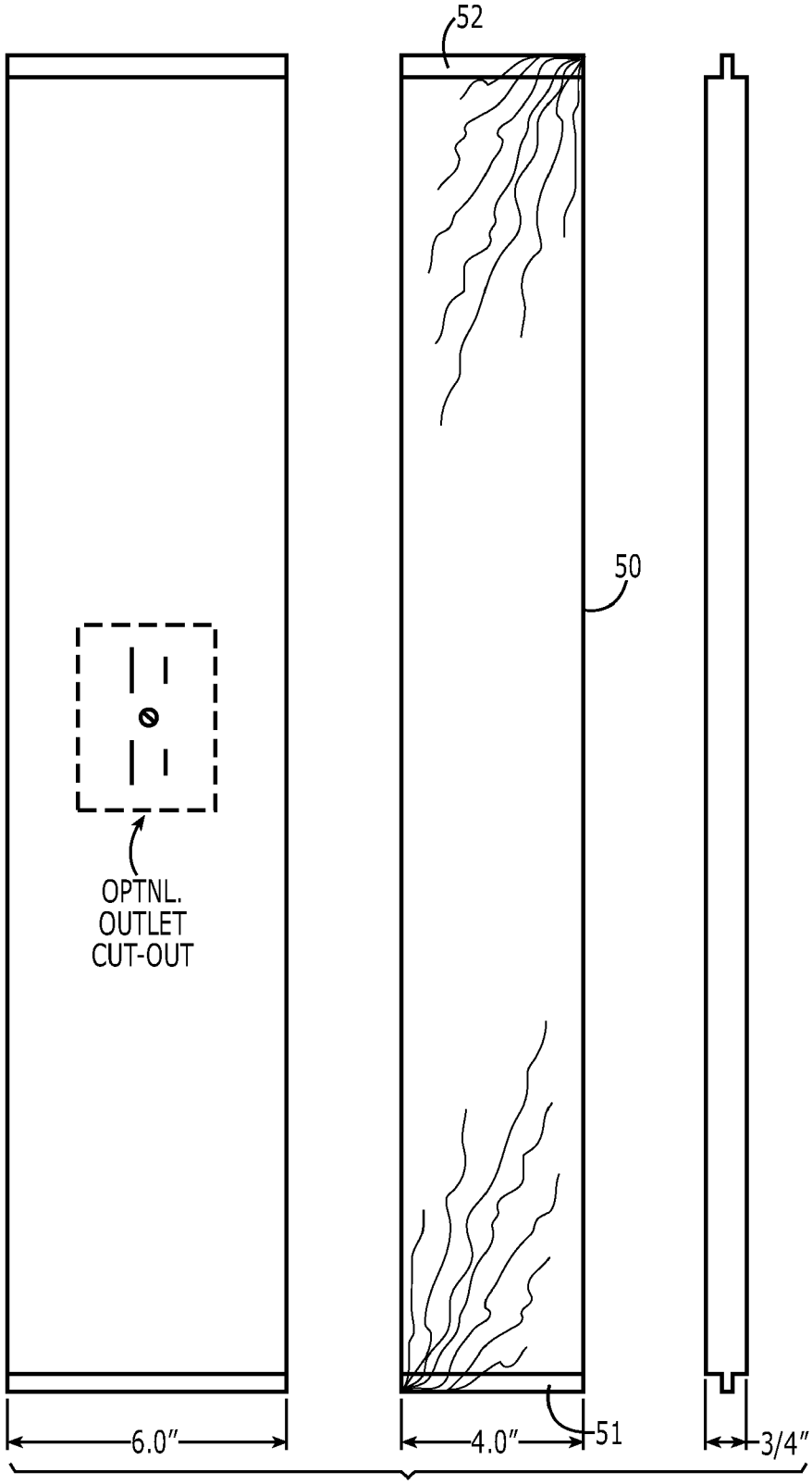
FIG. 5 shows a front and side view of various embodiments of vertical decorative strips for use with the modular wall panel system of FIG. 1.

Positioned between bottom horizontal decorative strip 20 and top horizontal decorative strip 30 are vertical decorative strips 50 (shown in detail in FIG. 5). Vertical decorative strips 50 are provided bottom tongues 51 and top tongues 52. Bottom tongues 51 are configured to mate with groove 23 on bottom horizontal decorative strip 20 (simultaneously occupying groove 23 with front lip 13 of lower intermediate rail 12), while top tongues 52 are configured to mate with bottom groove 31 on top horizontal decorative strip 30 (simultaneously occupying groove 31 with front lip 15 of upper intermediate rail 14). As shown in FIG. 5, vertical decorative strips 50 may optionally be provided in a variety of dimensions, and may optionally include a cut-out portion 53 to receive an electrical power outlet, data outlet, or other plug connection to suit the installation environment.

Figure 6:
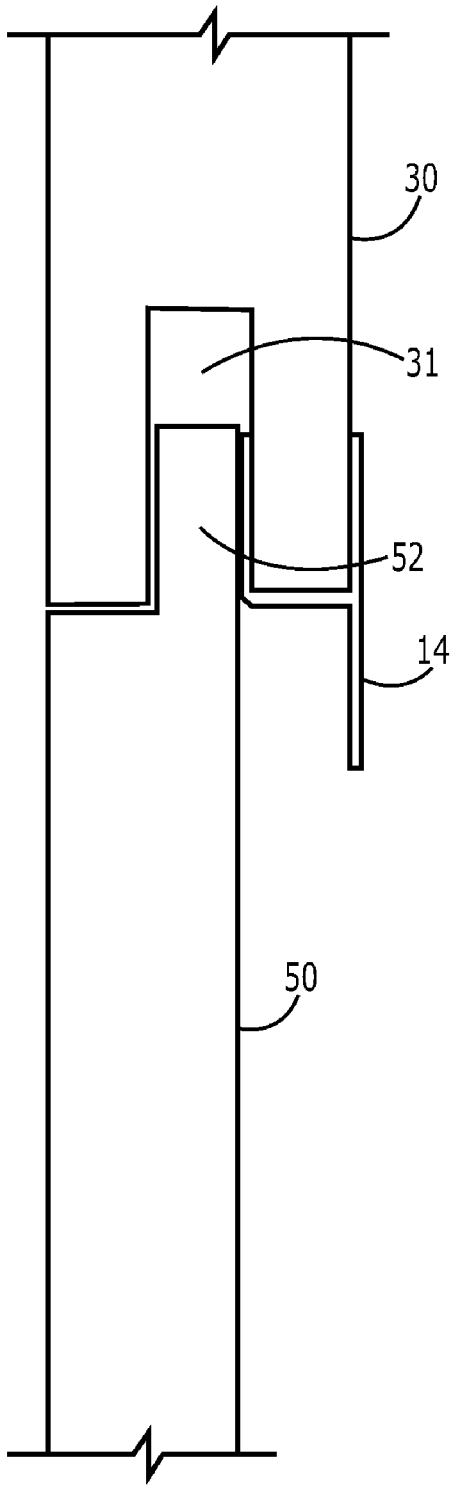
FIG. 6 shows a partial cross-sectional view of portions of the modular wall panel system of FIG. 1.

Optionally, as shown in FIG. 6, vertical decorative strips 50 may be planed along their back surface, thus creating a spacing between decorative strips 50 and the wall surface to allow cabling (e.g., telephone, electrical, etc.) to run behind the modular wall panel system.

Figure 7:
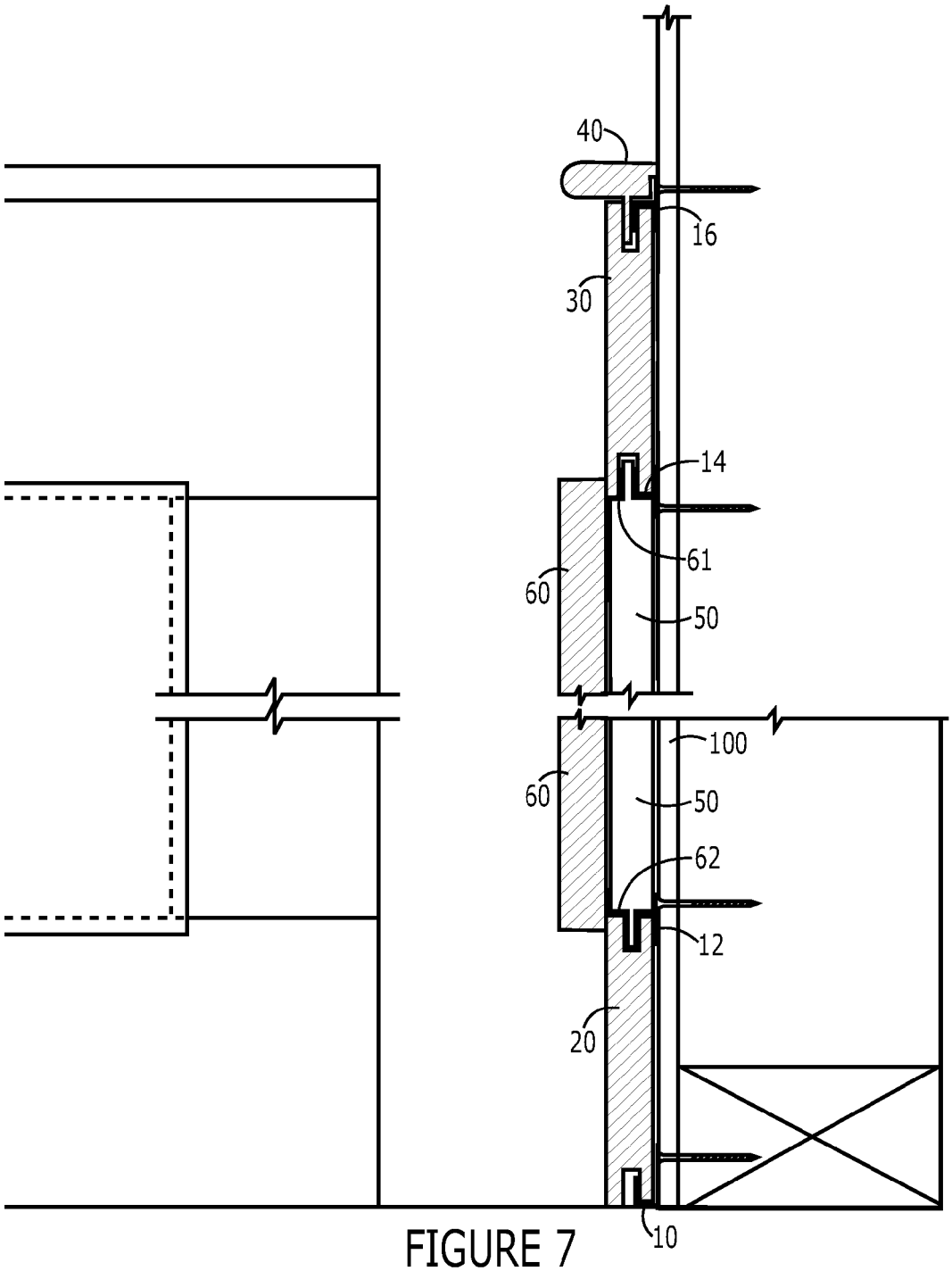
FIG. 7 shows a partial, side, sectional view and front view of the modular wall panel system of FIG. 1 taken along line A-A of FIG. 1.

Vertical decorative panels 60 are likewise provided between vertical decorative strips 50. As shown in the front view of FIG. 1, a plurality of vertical decorative panels 60 are preferably provided in the modular wall system to provide a finished, decorative wainscoting to a wall. As shown in FIG. 1, each vertical decorative panel 60 is framed on its top and bottom by top horizontal decorative strip 30 and bottom horizontal decorative strip 20, respectively, and on each side by a vertical decorative strip 50, all in such configuration so as to hide horizontal frame members 10, 12, 14, and 16 from view. As best seen in the partial, side, sectional view and front view of FIG. 7 (view taken along line A-A of FIG. 1), vertical decorative panel 60 is fitted to the modular wall system by way of a top bracket 61 and a bottom bracket 62, each of which is generally in the form of a z-bracket and preferably formed of the same material as horizontal frame members 10, 12, 14, and 16. Top bracket 61 thus has an upwardly extending arm configured to fit within bottom groove 31 of top horizontal decorative strip 30 (simultaneously with front lip 15 of upper intermediate rail 14). Likewise, bottom bracket 62 has a downwardly extending arm configured to fit within groove 23 of bottom horizontal decorative strip 20 (simultaneously with front lip 13 of lower intermediate rail 12). Top bracket 61 and bottom bracket 62 are preferably vertically positioned on the back of vertical decorative panel 60 so as to allow sufficient vertical clearance to allow top bracket first to be inserted into groove 31, and then have the entire panel 60 slide downward so as to engage bottom bracket 62 in groove 23, thus holding decorative panel 60 in place but allowing movement and in fact easy removal thereof from the modular wall system. As shown in FIGS. 1 and 7, the outer perimeter of decorative panel 60 preferably overlaps the edges of bottom horizontal decorative strip 20, top horizontal decorative strip 30, and the edges of vertical decorative strips 50. As decorative panels 60 are able to "float" in this configuration, the extent to which the edges of decorative panels 60 overlap the edges of vertical decorative strips 50 can vary, thus allowing the system to easily adapt to walls of various dimensions.

Optionally, one or more decorative panels 60 (or a portion thereof) may be hinged to either a structural member of wall 100, or to one of the vertical decorative strips 50, bottom decorative strip 20, or top decorative strip 30 to allow greater and easier access to the space behind decorative panel 60. In such embodiment, the space behind decorative panel 60 may be used, for example, to position wall safes, electronic equipment, television screens and monitors, or any other device that a homeowner might wish to conceal from view when not in use.

As best seen in FIG. 7, when decorative panels 60 are installed, an open space exists between the back surface of decorative panels 60 and wall 100. Such open space allows peripheral elements, such as cabling including electrical power cables, data or voice communication cables, or other cables and/or connectors, lighting elements, or any other thin profile elements to be positioned behind decorative panels 60. This configuration significantly eases installation of the modular wall system. For instance, if an electrical, telephone, data, or cable television outlet is positioned in the wall that is to be covered by the modular wall system, such outlet need not be removed or moved. Rather, an outlet box may be mounted in panel 60, and an appropriate cable may be run from the outlet box mounted in decorative panel 60 to the preexisting outlet mounted in wall 100. Further, a portion of decorative panel 60 may be formed of frosted glass or another preferably opaque surface, and a light bulb or other lighting element may be positioned behind decorative panel 60 to provide a backlighting effect. Still further, a portion of decorative panel 60 may be removed to accommodate a peripheral device insert, such as a speaker or other electronic device, which while flush mounted within the modular wall system may be easily connected to an audio jack or other outlet positioned behind decorative panel 60 without changing the position of such preexisting audio jack or other outlet.

In order to promote the ability to provide such alternate peripheral devices and/or alternate aesthetics for the modular, decorative wall panel system, decorative panels may be equipped with removable inserts 65 (FIG. 2) fitted within a central recess within decorative panel 60. Insert 65 is preferably removably attached to decorative panel 60 using magnets, clips, or any other removable attachment device as will be apparent to those of ordinary skill in the art. By providing interchangeability of such inserts 65, a homeowner may easily and quickly modify the modular wall panel system as they may see fit, such as to change aesthetics to complement a change in furniture placed within the room in which the modular wall panel system is used, to move the locations of electrical, data, or communications outlets, or any other purpose that might be met through a reorientation of the panels.

The invention has been described with references to a preferred embodiment. While specific values, relationships, materials, and steps have been set forth for purposes of describing concepts of the invention, it will be appreciated by persons skilled in the art that numerous variations and/or modifications may be made to the invention as shown in the specific embodiments without departing from the spirit or scope of the basic concepts and operating principles of the invention. It should be recognized that, in the light of the above teachings, those skilled in the art can modify those specifics without departing from the invention taught herein. Having now fully set forth the preferred embodiments and certain modifications of the concept underlying the present invention, various other embodiments as well as certain variations and modifications of the embodiments shown and described will obviously occur to those skilled in the art upon becoming familiar with said underlying concept. It is intended to include all such modifications, alternatives and other embodiments in this invention. It should be understood, therefore, that the invention may be practiced otherwise than as specifically set forth herein. Consequently, the present embodiments are to be considered in all respects as illustrative and not restrictive.

The invention claimed is:

1. A wall panel system comprising:

a top rail fixedly attached to a wall and having a downwardly extending front lip;

a bottom rail fixedly attached to a wall and having an upwardly extending front lip;

an upper intermediate rail fixedly attached to said wall and positioned between said top rail and said bottom rail and having an upwardly extending front lip;

a lower intermediate rail fixedly attached to said wall and positioned between said top rail and said bottom rail and having a downwardly extending front lip;

an upper decorative horizontal strip removably held by said top rail and said upper intermediate rail and having a top groove along a top side thereof and a bottom groove along a bottom side thereof;

a lower decorative horizontal strip removably held by said bottom rail and said lower intermediate rail and having a top groove along a top side thereof and a bottom groove along a bottom side thereof;

a plurality of vertical decorative strips removably held by said upper decorative horizontal strip and said lower decorative horizontal strip and having a top tongue at a top side thereof and a bottom tongue at a bottom side thereof, wherein said top tongue is positioned within said bottom groove of said upper decorative horizontal strip simultaneously with said upwardly extending front lip of said upper intermediate rail, and wherein said bottom tongue is positioned within said top groove of said lower decorative horizontal strip simultaneously with said downwardly extending front lip of said lower intermediate rail; and a plurality of decorative panels removably held by said upper decorative horizontal strip and said lower decorative horizontal strip and having a front surface and a rear surface, an upper bracket positioned near a top edge of said rear surface, and a lower bracket positioned near a bottom edge of said rear surface, wherein said upper bracket is positioned within said bottom groove of said upper decorative horizontal strip simultaneously with said upwardly extending front lip of said upper intermediate rail, and wherein said lower bracket is positioned within said top groove of said lower decorative horizontal strip simultaneously with said downwardly extending front lip of said lower intermediate rail.

2. The wall panel system of claim 1, wherein said system is configured such that said top rail, said bottom rail, said upper intermediate rail, and said lower intermediate rail are hidden from view when said wall panel system is installed on a wall.

3. The wall panel system of claim 1, further comprising a horizontal trim cap removably held by said top rail.

4. The wall panel system of claim 3, wherein said horizontal trim cap further comprises an exposed upper decorative portion and a tongue extending downwardly from said upper decorative portion and configured to sit within an upper groove on said upper decorative horizontal strip.

5. The wall panel of claim 1, wherein an open space exists between a back surface of at least one of said decorative panels and a wall on which said panel system is installed, said open space having a depth dimension at least as large as a thickness of said vertical decorative strips.

6. The wall panel system of claim 1, at least one of said decorative panels further comprising a removable insert positioned at a front face of said at least one of said decorative panels.

7. The wall panel system of claim 6, said removable insert having a peripheral electronic device integrated therein.

8. The wall panel system of claim 7, wherein said peripheral electronic device is selected from the group consisting of an electrical outlet, a communication port, a data port, a speaker, and a lighting device.

9. The wall panel system of claim 1, wherein at least a portion of at least one of said decorative panels is hingedly connected so as to allow access to an open area behind said decorative panel.

10. A wall panel system configured for attachment to a wall surface comprising:

a top rail configured for fixed attachment to a wall, said top rail having a downwardly extending front lip;

a bottom rail configured for fixed attachment to a wall, said bottom rail having an upwardly extending front lip;

an upper intermediate rail configured for fixed attachment to a wall, said upper intermediate rail having an upwardly extending front lip;

a lower intermediate rail configured for fixed attachment to a wall, said lower intermediate rail having a downwardly extending front lip;

an upper decorative horizontal strip having a top groove along a top side thereof and having a bottom groove along a bottom side thereof;

a lower decorative horizontal strip having a top groove along a top side thereof and having a bottom groove along a bottom side thereof;

a plurality of vertical decorative strips, each of said vertical decorative strips having a top tongue at a top side thereof and a bottom tongue at a bottom side thereof, wherein each said top tongue is configured to fit within said bottom groove of said upper decorative horizontal strip simultaneously with said upwardly extending front lip of said upper intermediate rail, and wherein each said bottom tongue is configured to fit within said top groove of said lower decorative horizontal strip simultaneously with said downwardly extending front lip of said lower intermediate rail; and a plurality of decorative panels having a front surface and a rear surface, an upper bracket positioned near a top edge of said rear surface, and a lower bracket positioned near a bottom edge of said rear surface, wherein said upper bracket is configured to fit within said bottom groove of said upper decorative horizontal strip simultaneously with said upwardly extending front lip of said upper intermediate rail, and wherein said lower bracket is configured to fit within said top groove of said lower decorative horizontal strip simultaneously with said downwardly extending front lip of said lower intermediate rail.

11. The wall panel system of claim 10, wherein at least a front surface of said upper decorative horizontal strip, a front surface of said lower decorative horizontal strip, front surfaces of said plurality of vertical decorative strips, and said front surfaces of said plurality of decorative panels comprise finished surfaces.

12. The wall panel system of claim 10, further comprising a horizontal trim cap configured for removably attachment to said upper decorative horizontal strip.

13. The wall panel system of claim 12, wherein said horizontal trim cap further comprises an exposed upper decorative portion and a tongue extending downwardly from said upper decorative portion and configured to sit within said top groove of said upper decorative horizontal strip.

14. The wall panel system of claim 10, wherein said upper brackets and said lower brackets on said plurality of decorative panels are configured such that when said upper bracket is positioned within the bottom groove of upper decorative horizontal strip and said lower bracket is positioned within the top groove of said lower decorative horizontal strip, an open space is defined between said rear surface of said decorative panel, said upper decorative horizontal strip, and said lower decorative horizontal strip.

15. The wall panel system of claim 10, wherein at least one of said decorative panels further comprises a removable insert positioned in said front surface of said at least one of said decorative panels.

16. The wall panel system of claim 15, said removable insert having a peripheral electronic device integrated therein.

17. The wall panel system of claim 16, wherein said peripheral electronic device is selected from the group consisting of an electrical outlet, a communication port, a data port, a speaker, and a lighting device.

18. The wall panel system of claim 10, wherein at least one of said decorative panels further comprises at least one hinge mounted on said rear surface of said decorative panel.

* * * * *